US006880205B2

(12) United States Patent
Rupprechter

(10) Patent No.: US 6,880,205 B2
(45) Date of Patent: Apr. 19, 2005

(54) HINGE

(75) Inventor: Helmut Rupprechter, Dornbirn (AT)

(73) Assignee: Julius Blum Gesellschaft m.b.H., Höchst (AT)

( * ) Notice: Subject to any disclaimer, the term of this patent is extended or adjusted under 35 U.S.C. 154(b) by 12 days.

(21) Appl. No.: 10/447,141

(22) Filed: May 29, 2003

(65) Prior Publication Data

US 2004/0006846 A1 Jan. 15, 2004

(30) Foreign Application Priority Data

Jul. 15, 2002 (AU) ..... 469/2002

(51) Int. Cl.[7] ..... E05D 7/04
(52) U.S. Cl. ..... 16/235; 16/238; 16/242
(58) Field of Search ..... 16/242, 240, 245, 16/238, 235, 236, 382, 265, 271, 272, 273

(56) References Cited

U.S. PATENT DOCUMENTS

| | | | | | |
|---|---|---|---|---|---|
| 4,007,514 | A | * | 2/1977 | Salice | 16/240 |
| 4,506,409 | A | * | 3/1985 | Lautenschlager | 15/238 |
| 4,604,769 | A | * | 8/1986 | Rock et al. | 16/238 |
| 4,716,622 | A | * | 1/1988 | DeBruyn | 16/297 |
| 5,027,474 | A | | 7/1991 | Bowers | |
| 5,283,929 | A | * | 2/1994 | Lin | 16/237 |
| 5,737,804 | A | * | 4/1998 | Ferrari et al. | 16/242 |
| 6,049,946 | A | | 4/2000 | Cress et al. | |
| 6,289,556 | B1 | * | 9/2001 | Salice | 16/335 |
| 6,442,798 | B1 | * | 9/2002 | Rupprechter | 16/242 |
| 6,622,343 | B1 | * | 9/2003 | Rupprechter | 16/242 |
| 6,643,895 | B1 | * | 11/2003 | Domenig et al. | 16/238 |

FOREIGN PATENT DOCUMENTS

| | | | | |
|---|---|---|---|---|
| DE | 3218375 A | * | 11/1983 | E05D/1/02 |
| EP | 1030021 A2 | * | 8/2000 | E05D/7/04 |

* cited by examiner

*Primary Examiner*—Chuck Y. Meh
(74) *Attorney, Agent, or Firm*—Wenderoth, Lind & Ponack, L.L.P.

(57) ABSTRACT

A hinge for anchoring a door leaf (2) to a frame (1) of an item of furniture has a base plate (5) that may be secured to the frame (1) and an intermediate piece (3) on which there is mounted a hinge arm (4) connected to a hinge pot (8) that may be secured to the door leaf (2) by way of at least one articulating pin (9). An adjusting and/or fixing mechanism is provided by means of which the hinge arm (4) may be fixed in different positions on the intermediate piece (3). The intermediate piece (3) is provided with a bracket (15) that has lateral marginal projections (15') and is punched out of the intermediate piece (3). The hinge arm (4) has a region that is C-shaped in cross-section. Inwardly directed projections (7) of this region reach behind the marginal projections (15') of the bracket (15), as a result of which the hinge arm (4) is anchored to the bracket (15).

20 Claims, 8 Drawing Sheets

HINGE

BACKGROUND OF THE INVENTION

The invention relates to a hinge for anchoring a door leaf to a frame of an item of furniture, having a base plate that may be secured to the frame and on which a hinge arm is mounted directly or indirectly by way of an intermediate piece to which a hinge pot that may be secured to the door leaf is connected by way of at least one articulating pin. At least one adjusting and/or fixing means is provided, by means of which the hinge arm may be fixed in different positions on the base plate or on the intermediate piece, and a bracket or the like to which the hinge arm is anchored is punched out of the base plate or the intermediate piece.

In modern furniture making, what are commonly called door frames are being used more and more widely, these frames forming a stable part that bears the hinges for the door leaves and the actual side walls of the furniture carcass being made from relatively weal material. This creates the advantage either that the overall costs of the item of furniture can be reduced, since the side walls can be extremely thin, or that higher-quality and hence visually more attractive materials can be selected for the side walls without the items of furniture being expensive by comparison with furniture made in conventional ways.

A hinge of this kind is known from EP 1 030 021 A2.

SUMMARY OF THE INVENTION

The object of the invention is, with a hinge of this kind, to achieve good anchoring of the hinge arm with simple means, there being the possibility that the position of the hinge arm may be adjusted.

The object of the invention is achieved in that the bracket, which extends in the longitudinal direction of the hinge arm, has lateral marginal projections that are punched out of the base plate or the intermediate piece in one piece with the bracket, and in that the hinge arm has a region that is C-shaped in cross-section and by means of which it may be pushed onto the bracket, with inwardly directed projections of the C-shaped region reaching behind the marginal projections of the bracket.

BRIEF DESCRIPTION OF THE DRAWINGS

Various example embodiments of the invention will be described below with reference to the figures in the attached drawings, in which:

FIG. 6 shows an end view of the intermediate piece with the hinge arm hooked in.

DETAILED DESCRIPTION OF THE PREFERRED EMBODIMENTS

Figure 1:
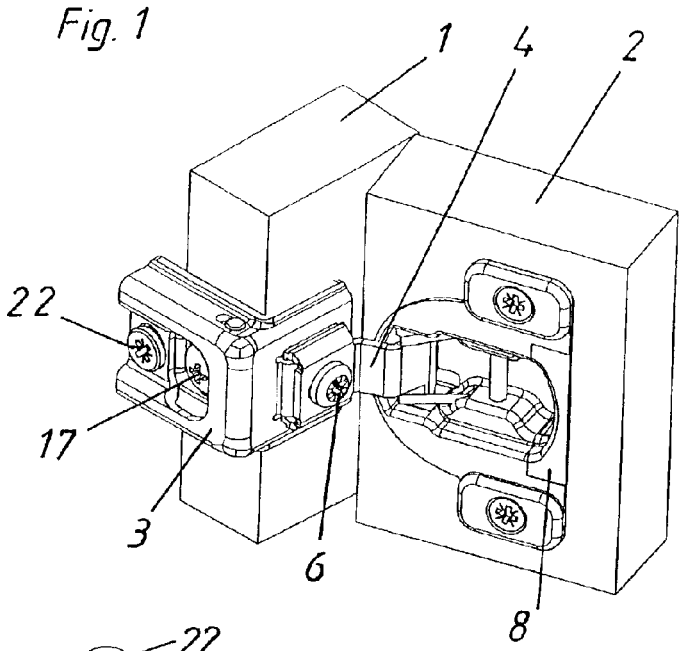
FIG. 1 shows diagrammatically a frame portion and a section of a door, which are connected to one another by a hinge according to an exemplary embodiment of the invention.

In the drawing figures, of the item of furniture, only sections of a door frame 1 and a door leaf 2 are shown. The door leaf 2 is anchored to the furniture frame 1 by means of two or more hinges according to the invention. Directly on the furniture frame 1 there is mounted a base plate 5 that, in the exemplary embodiment, reaches around the door frame 1 in the shape of a U.

A hinge pot 8 is inserted in a bore in the door leaf 2. A hinge arm 4 is mounted in the hinge pot 8 by means of a hinge pin 9, with the hinge pot 8 rotatable or tiltable about the hinge pin 9 in relation to the hinge arm 4.

In the exemplary embodiments shown, the hinge pin 9 is formed by a peg of a bracket 10 that projects laterally through the hinge pot 8. Mounted on a rear peg 11 of the bracket 10 are springs 12 that abut with one limb against pressure faces 13 of the hinge arm 4 and so hold the hinge pot 8 and the door leaf 2 in the closed position.

Mounted on the base plate 5 is an intermediate piece 3 that is L-shaped in side view. The base plate 5 and the intermediate piece 3 are preferably made from sheet steel.

The base plate 5 has an elongate hole 16 through which there projects a screw 17 by means of which the base plate 5 is secured to the furniture frame 1. The elongate hole 16 allows the height of the hinge in the item of furniture to be adjusted.

A bracket 15 that extends in the longitudinal direction of the hinge arm 4 is punched out of a web 14 of the intermediate piece 3 that abuts against the front side of the frame 1. The hinge arm 4 is pushed onto this bracket 15 and thus anchored to the intermediate piece 3. The bracket 15 could also be punched directly out of the base plate 5. The hinge arm 4 is thus mounted to the base plate 5 either directly by the bracket 15 on the base plate 5, or indirectly by way of the intermediate piece 3 having the bracket 15. In this way, both the base plate 5 and the intermediate piece 3 represent a hinge member securable to the frame to which the hinge arm can be mounted by way of the bracket 15. The effect of the intermediate piece 3 as the hinge member is to gain an additional possibility of adjustment in the depth direction of the item of furniture, with the intermediate piece 3 being displaceable on the base plate 5 by means of an eccentric 22.

The bracket 15 is punched out of the intermediate piece 3 such that it has laterally projecting marginal projections 15'. The hinge arm 4 has a C-shaped region 4' with inwardly directed projections 7. When the hinge arm 4 is pushed onto the bracket 15 the projections 7 of the hinge arm 4 reach behind the marginal projections 15' of the bracket 15.

Figure 2:
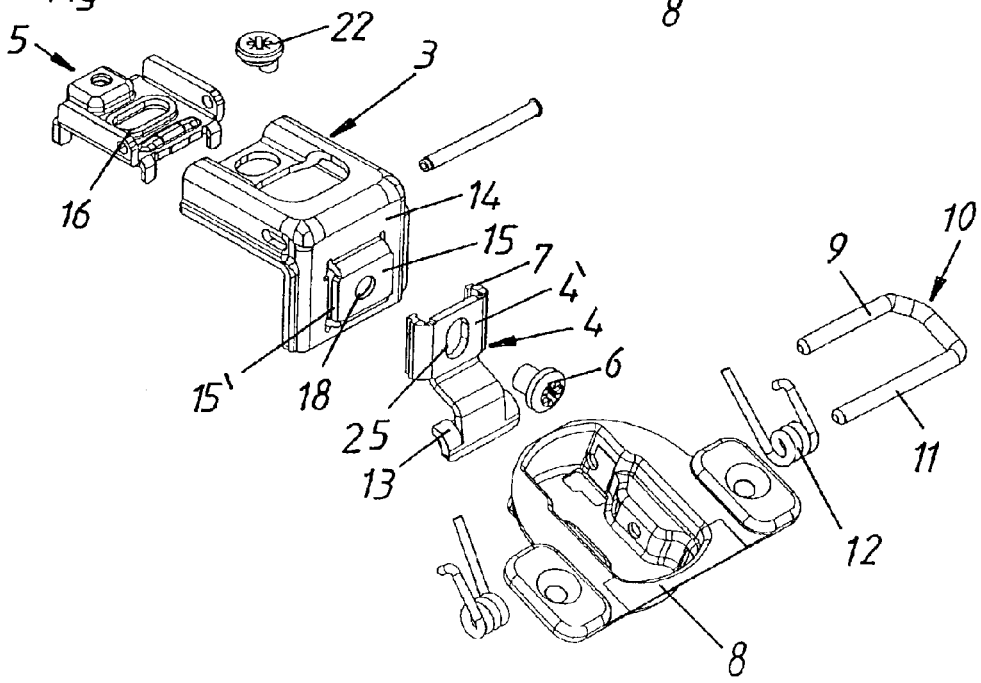
FIG. 2 shows diagrammatically, and in exploded view, a hinge according to the invention.
Figure 3:
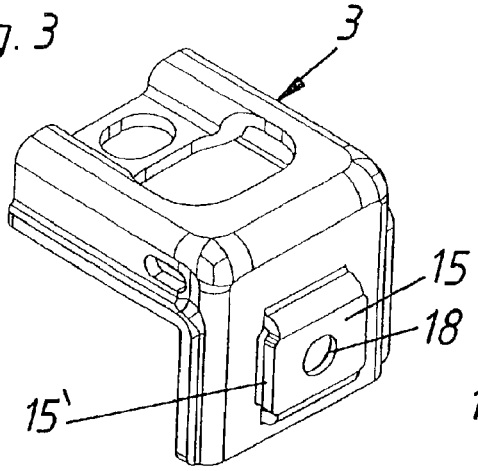
FIG. 3 shows a diagram of an intermediate piece.
Figure 4:
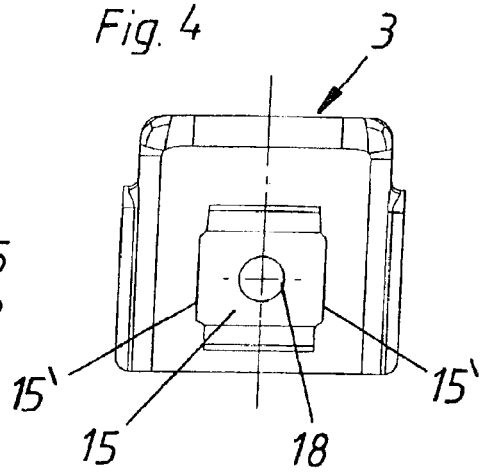
FIG. 4 shows an end view of the intermediate piece.
Figure 5:
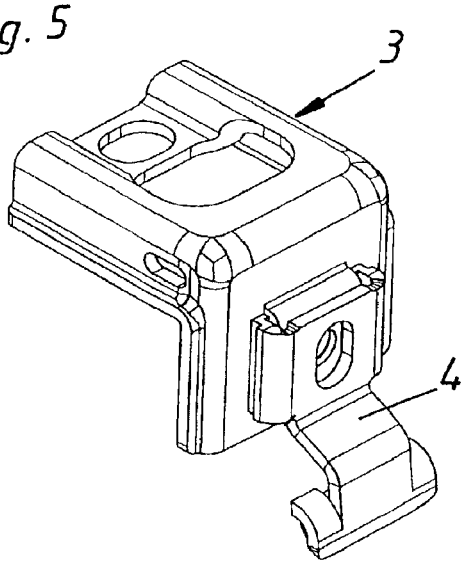
FIG. 5 shows a diagram of the intermediate piece and a hinge arm, with the hinge arm being hooked into the intermediate piece.
Figure 6:
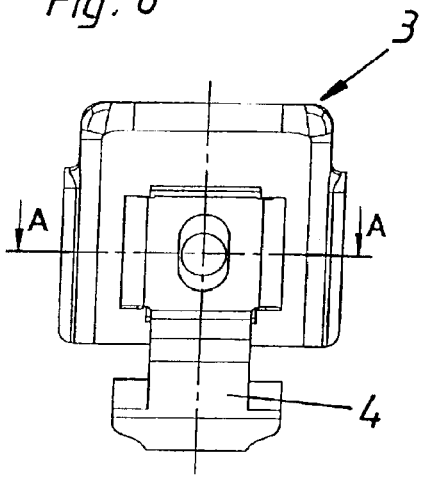
Figure 7:
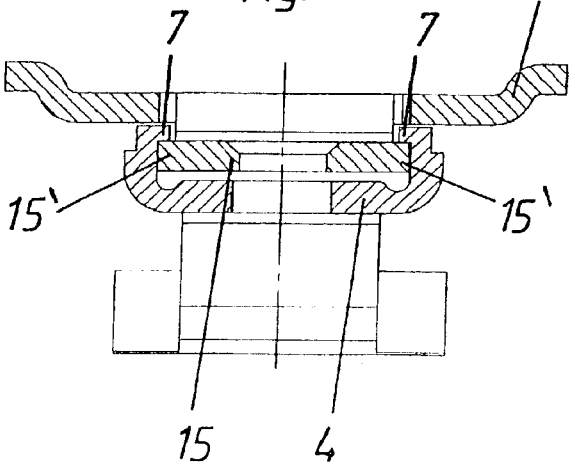
FIG. 7 shows a section taken along line A—A in FIG. 6.
Figure 8:
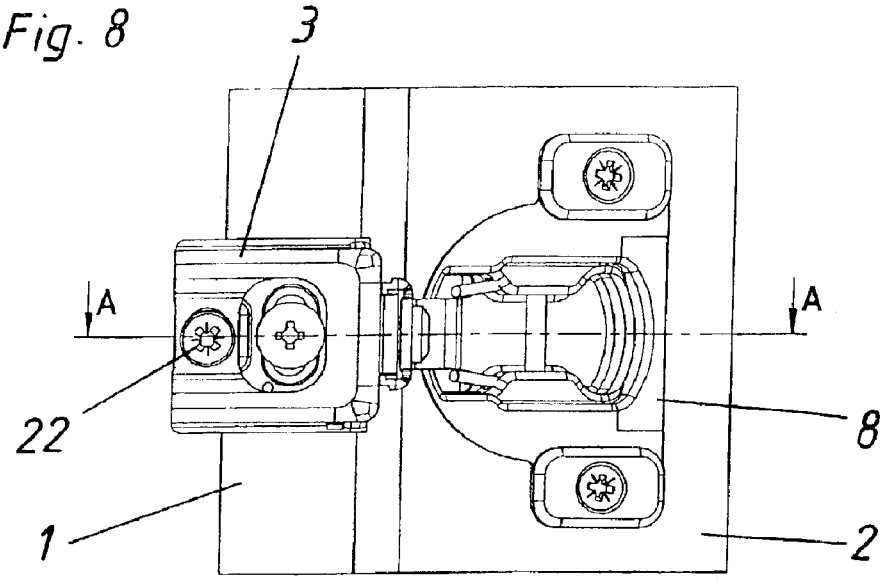
FIG. 8 shows a plan view of a hinge according to the invention.
Figure 9:
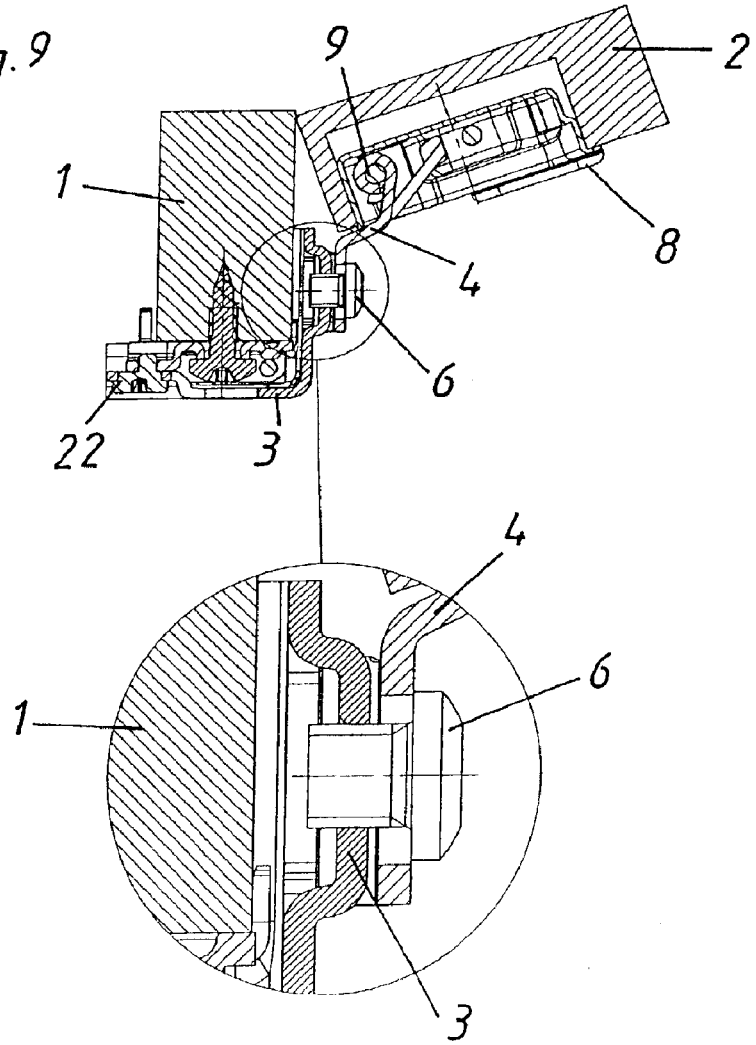
FIG. 9 shows a section taken along line A—A in FIG. 8.

In the exemplary embodiment according to FIGS. 1 to 7, the bracket 15 has a threaded bore 18 in which a clamping screw 6 is mounted. The hinge arm 4 is provided with an elongate hole 26 aligned perpendicular to the hinge pin 9.

The hinge arm 4 is clamped to the bracket 15 in the assembled position by tightening the clamping screw 6. If the clamping screw 6 is slightly loosened, it is possible to adjust the hinge arm 4 perpendicular to the hinge pin 9, as a result of which an adjustment to the door leaf 2 in the direction of the furniture join is achieved. The projections 7 of the hinge arm 4 are in this case displaced along the marginal projections 15' of the bracket 15.

Figure 10:
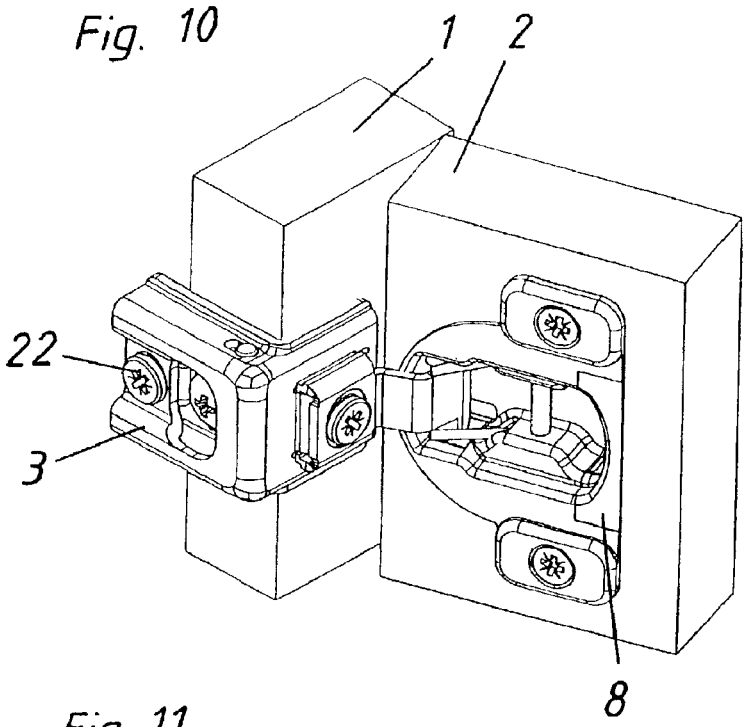
FIG. 10 shows diagrammatically a frame portion and a section of a door, which are connected to one another by a hinge according to a further exemplary embodiment of the invention.
Figure 11:
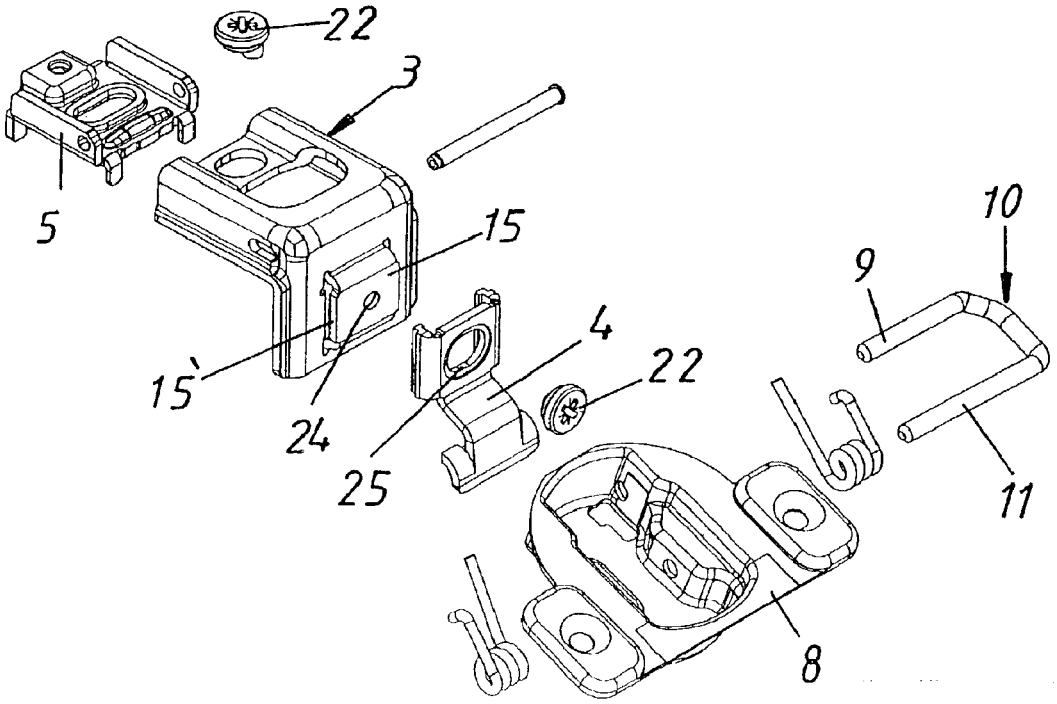
FIG. 11 shows diagrammatically and in exploded view the exemplary embodiment of a hinge according to the invention of FIG. 10.
Figure 12:
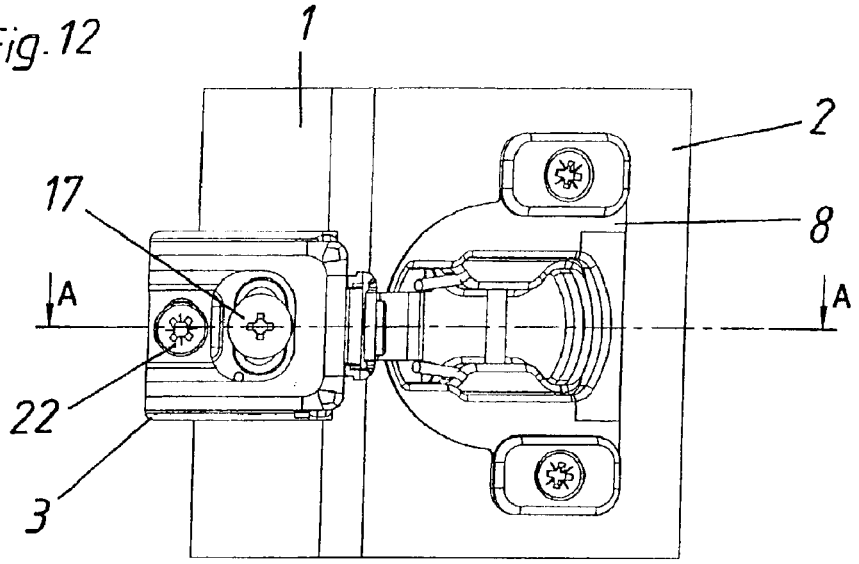
FIG. 12 shows a plan view of the hinge according to the invention.
Figure 13:
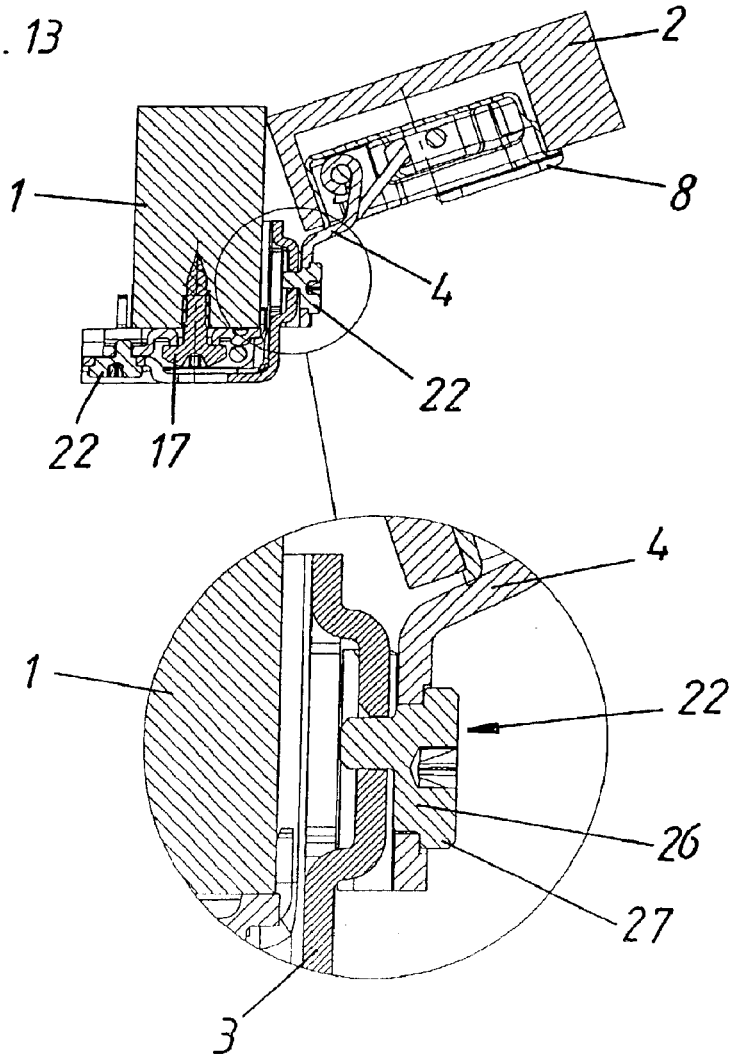
FIG. 13 shows a section taken along line A—A in FIG. 12.

In the exemplary embodiment according to FIGS. 10 to 13, the hinge arm 4 is adjusted directly by an eccentric 22.

In the assembled position, the hinge arm 4 is once again pushed onto the bracket 15, with the projections 7 of the hinge arm 4 reaching behind the marginal projections 15' of the bracket 15.

An adjustment to the hinge arm 4 in the direction of the furniture join is achieved by means of the eccentric 22, which is mounted rotatably in a hole 24 in the bracket 15 by means of a peg.

The hinge arm 4 is once again provided with an elongate hole 25 but this time it is aligned transversely with respect to the hinge arm 4.

The eccentric cam 26 of the eccentric 22 is received in the elongate hole 25 in the assembled position.

The eccentric 22 is riveted in the bracket 15 by its peg and has a head 27 abutting against the outside of the bracket 15. As a result of this construction, the hinge arm 4 is held non-detachably against the intermediate piece 3.

Figure 14:
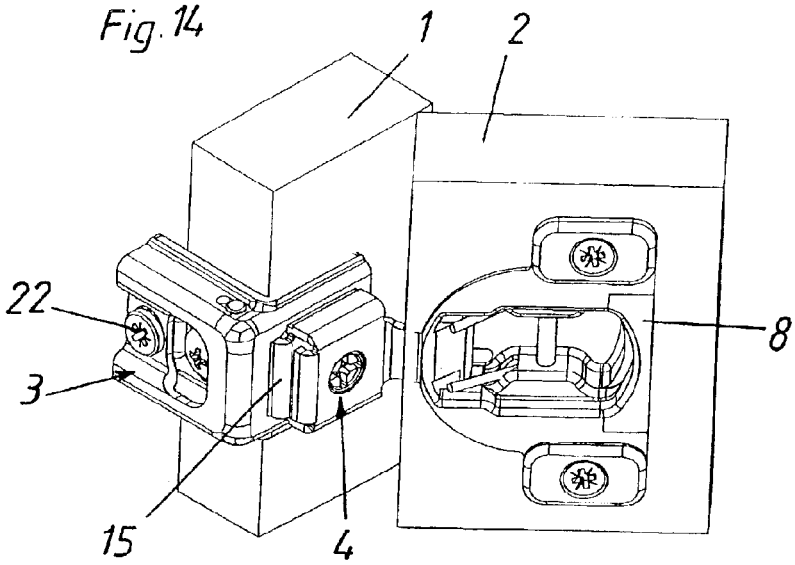
FIG. 14 shows diagrammatically a frame portion and a section of a door, which are connected to one another by a hinge according to a further exemplary embodiment of the invention.
Figure 15:
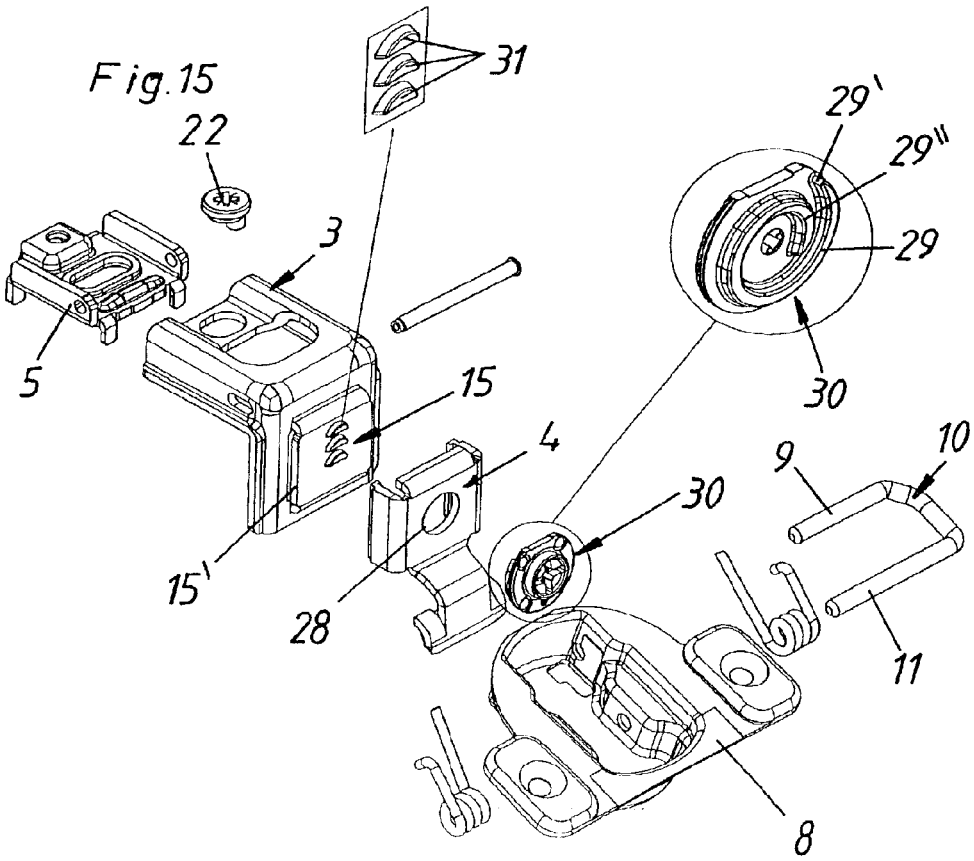
FIG. 15 shows diagrammatically and in exploded view the hinge according to the invention in the exemplary embodiment of FIG. 14.
Figure 16:
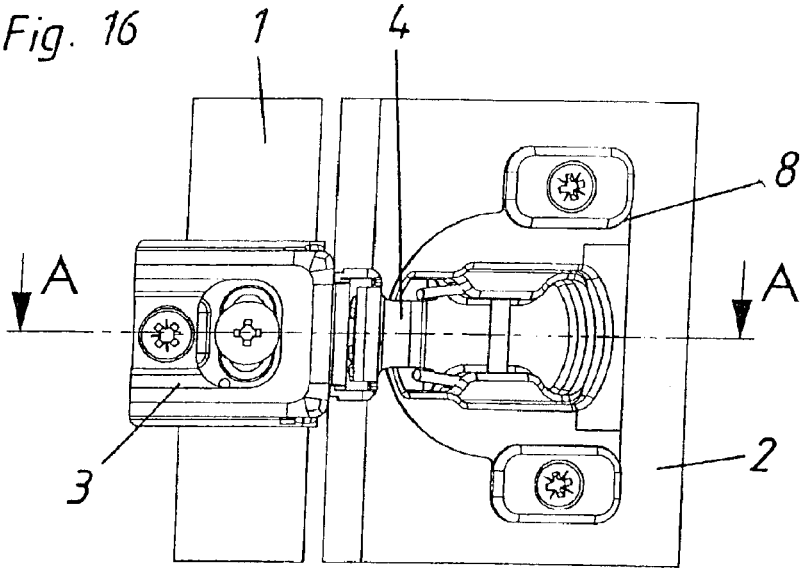
FIG. 16 shows a plan view of a hinge according to the invention.
Figure 17:
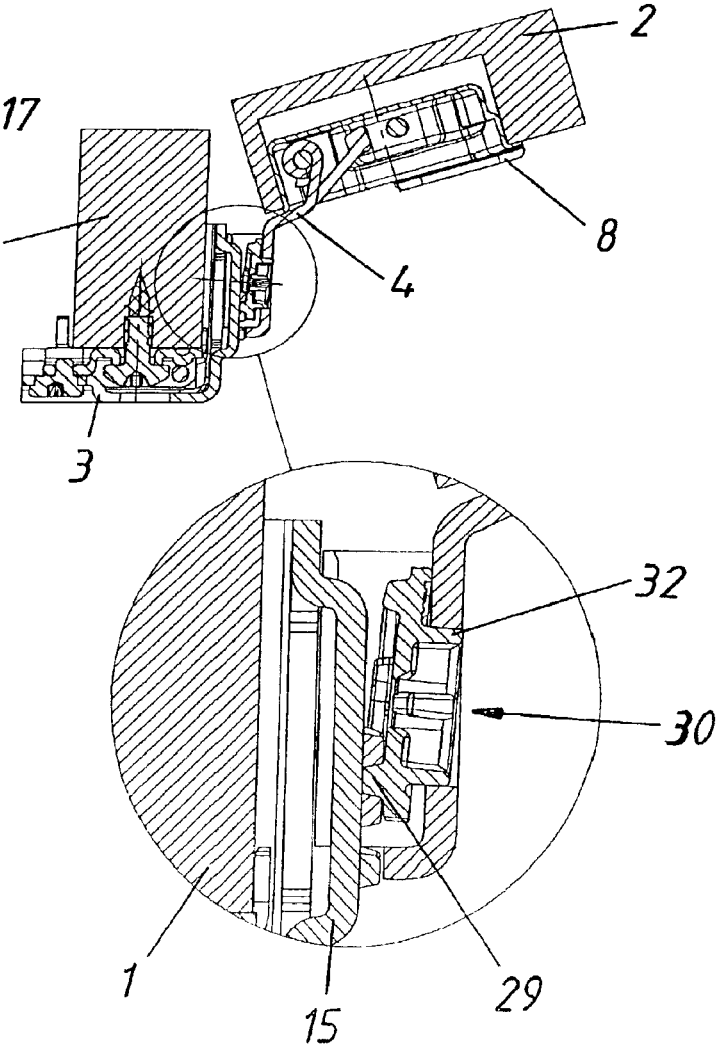
FIG. 17 shows a section taken along line A—A in FIG. 16.
Figure 18:
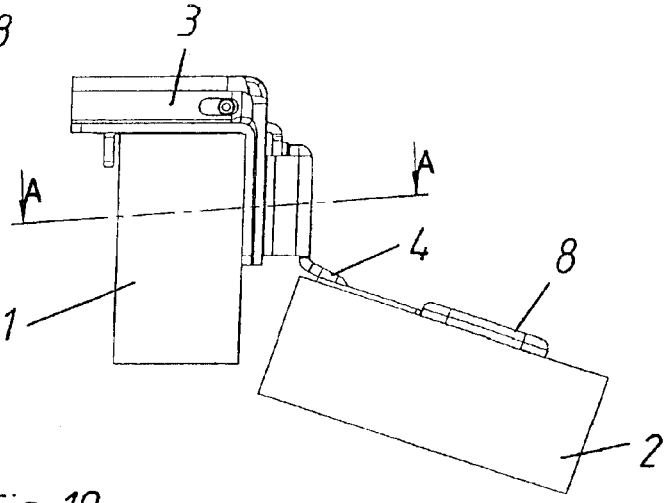
FIG. 18 shows a plan view of a hinge, seen in the direction of the hinge pin.
Figure 19:
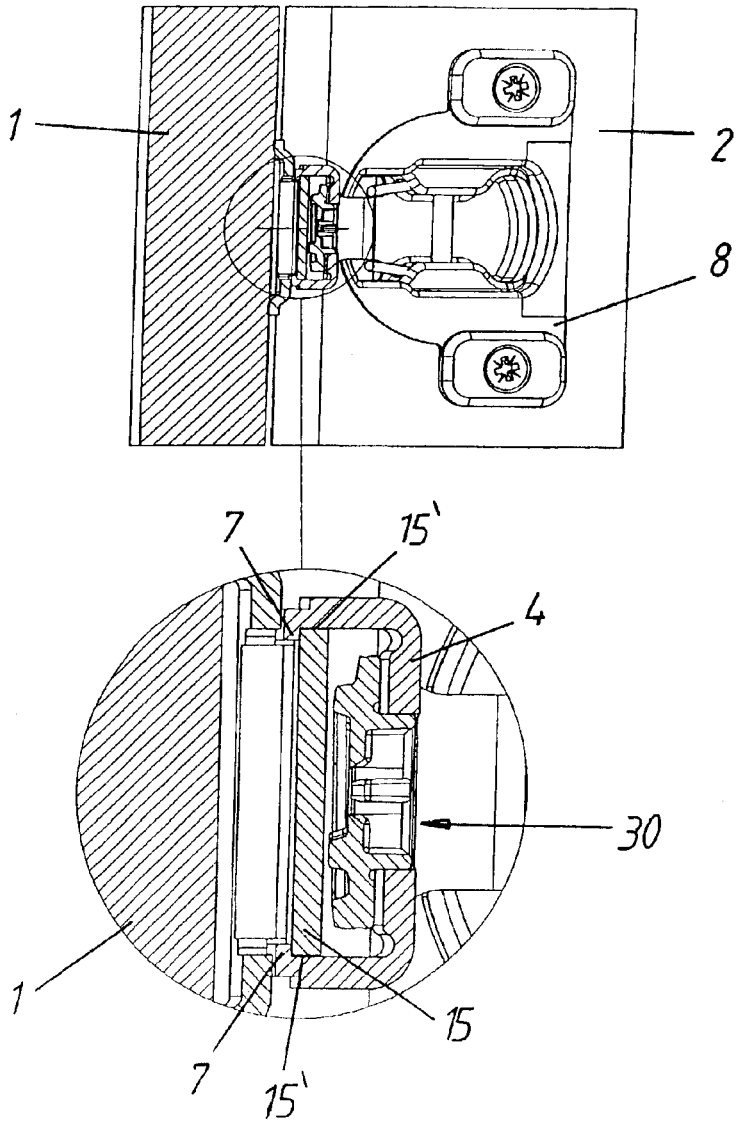
FIG. 19 shows a section taken along line A—A in FIG. 18.

In the exemplary embodiment according to FIGS. 14 to 19, an adjustment to the position of the hinge arm 4 is achieved by means of a spiral washer 30. The spiral washer 30 is mounted in a mounting seat 28 in the hinge arm 4 and has a web-shaped spiral 29 that is supported against cam-type projections 31 constructed on the bracket 15. The mounting seat 28 is formed by a punched hole.

In the exemplary embodiment shown, the spiral 29 has two overlapping sections 29', 29".

The spiral washer 30 is provided with a base 32 that is received in the mounting seat 28 of the hinge arm 4 and enables access for an adjustment tool such as a screwdriver.

Turning the spiral washer 30 displaces the hinge arm 4 on the bracket 15 in the direction of the furniture door join.

What is claimed is:

1. A hinge for anchoring a door leaf to a frame of an item of furniture, comprising:

a hinge member securable to the frame;

a hinge arm mounted to said hinge member;

a hinge pot securable to the door leaf, said hinge pot being connected by at least one articulating pin to said hinge arm;

at least one adjusting mechanism operable to adjustably fix said hinge arm on said hinge member; and said adjusting mechanism comprising:

a bracket punched out of said hinge member;

wherein said hinge arm is anchored to said bracket;

wherein said bracket extends lengthwise with respect to said hinge arm and has lateral marginal projections punched out of said hinge member in one piece with said bracket;

wherein said hinge arm has a region that is C-shaped in cross-section by which said hinge arm can be pushed onto said bracket, said C-shaped region having inwardly directed projections reaching behind said marginal projections of said bracket.

2. The hinge of claim 1, wherein said hinge member comprises an intermediate piece that is securable to the frame by a base plate.

3. The hinge of claim 1, wherein said hinge arm is indirectly mounted to a base plate by said hinge member, said base plate being directly securable to the frame.

4. The hinge of claim 1, wherein said bracket has a flat central portion and said marginal projections are at least as long as said flat central portion.

5. The hinge of claim 1, wherein said bracket has a threaded bore in which a clamping screw is mounted, said clamping screw projecting through an elongate hole in said hinge arm.

6. The hinge of claim 5, wherein said threaded bore is in a flat central portion of said bracket.

7. The hinge of claim 1, wherein an eccentric is mounted in said bracket and projects into an elongate hole in said hinge arm.

8. The hinge of claim 7, wherein said eccentric is mounted in a flat central portion of said bracket.

9. The hinge of claim 1, wherein a spiral washer is mounted is said hinge arm and has, on a side thereof facing said bracket, a web-shaped spiral that abuts at least one projection on said bracket.

10. The hinge of claim 9, wherein said at least one projection comprises a plurality of projections arranged in a row on said bracket.

11. A hinge for anchoring a door leaf to a frame of an item of furniture, comprising:

a hinge member securable to the frame;

a hinge arm mounted to said hinge member;

a hinge pot securable to the door leaf, said hinge pot being connected by at least one articulating pin to said hinge arm;

at least one adjusting mechanism operable to adjustably connect said hinge arm to said hinge member; and said adjusting mechanism comprising:

a bracket punched out of said hinge member;

wherein said hinge arm is anchored to said bracket;

wherein said bracket has lateral marginal projections punched out of said hinge member in one piece with said bracket;

wherein said hinge arm has a region that is C-shaped in cross-section by which said hinge arm can be pushed onto said bracket, said C-shaped region having inwardly directed projections reaching behind said marginal projections of said bracket.

12. The hinge of claim 11, wherein said hinge member comprises an intermediate piece that is securable to the frame by a base plate.

13. The hinge of claim 11, wherein said hinge arm is indirectly mounted to a base plate by said hinge member, said base plate being directly securable to the frame.

14. The hinge of claim 11, wherein said bracket has a flat central portion and said marginal projections are at least as long as said flat central portion.

15. The hinge of claim 11, wherein said bracket has a threaded bore in which a clamping screw is mounted, said clamping screw projecting through an elongate hole in said hinge arm.

16. The hinge of claim 15, wherein said threaded bore is in a flat central portion of said bracket.

17. The hinge of claim 11, wherein an eccentric is mounted in said bracket and projects into an elongate hole in said hinge arm.

18. The hinge of claim 17, wherein said eccentric is mounted in a flat central portion of said bracket.

19. The hinge of claim 11, wherein a spiral washer is mounted is said hinge arm and has, on a side thereof facing said bracket, a web-shaped spiral that abuts at least one projection on said bracket.

20. The hinge of claim 19, wherein said at least one projection comprises a plurality of projections arranged in a row on said bracket.

* * * * *

UNITED STATES PATENT AND TRADEMARK OFFICE

CERTIFICATE OF CORRECTION

PATENT NO. : 6,880,205 B2
DATED : April 19, 2005
INVENTOR(S) : Helmut Rupprechter It is certified that error appears in the above-identified patent and that said Letters Patent is hereby corrected as shown below:

Title page,
Item [30], Foreign Application Priority Data, please change "(AU)" to -- (AT) --.

Signed and Sealed this

Fifth Day of July, 2005

JON W. DUDAS
*Director of the United States Patent and Trademark Office*